US006585390B2

(12) United States Patent
Stone et al.

(10) Patent No.: US 6,585,390 B2
(45) Date of Patent: Jul. 1, 2003

(54) ILLUMINATED DECORATIVE PURSE

(76) Inventors: Eric Craig Stone, No. 6, Holiday La., Frontenac, MO (US) 63131; Ann Lindberg Stone, No. 6, Holiday La., Frontenac, MO (US) 63131

( * ) Notice: Subject to any disclaimer, the term of this patent is extended or adjusted under 35 U.S.C. 154(b) by 0 days.

(21) Appl. No.: 10/047,851

(22) Filed: Jan. 15, 2002

(65) Prior Publication Data

US 2002/0093817 A1 Jul. 18, 2002

Related U.S. Application Data

(60) Provisional application No. 60/261,792, filed on Jan. 17, 2001.

(51) Int. Cl.[7] ..... A45C 15/06

(52) U.S. Cl. ..... 362/156; 362/154; 362/253

(58) Field of Search ..... 362/253, 154, 362/156, 217, 220, 223, 226

(56) References Cited

U.S. PATENT DOCUMENTS

| | | | | |
|---|---|---|---|---|
| 3,808,416 A | * | 4/1974 | Pottratz | 362/156 |
| 5,485,355 A | | 1/1996 | Voskoboinik et al. | 362/84 |
| 6,340,235 B1 | * | 1/2002 | Bryan | 362/156 |

* cited by examiner

*Primary Examiner*—Sandra O'Shea
*Assistant Examiner*—Guiyoung Lee
(74) *Attorney, Agent, or Firm*—Paul M. Denk

(57) ABSTRACT

An illuminated decorative purse, structured partially or fully of transparent material, whether it be of clear transparency, or colored transparency, may include within its interior a battery pack and circuitry, into which one or more cable-like electroluminescent light source may locate, be plugged into, and for illuminating the interior of the purse, and radiating its light waves exteriorly, to furnish a colorful display of white or other colored light from the purse as a novelty and attention gathering item. A false bottom or other compartment may be provided within the purse, for containment of the battery pack and its circuitry, and into which the cable-like sources may be plugged into, during usage.

15 Claims, 1 Drawing Sheet

ILLUMINATED DECORATIVE PURSE

CROSS-REFERENCE TO RELATED APPLICATION

This application is a nonprovisional patent application based upon provisional patent application having Serial No. 60/261,792 filed on Jan. 17, 2001 which is owned by the same inventor.

STATEMENT REGARDING FEDERALLY SPONSORED RESEARCH OR DEVELOPMENT

N/A

BACKGROUND OF THE INVENTION

Obviously, numerous styles of purses, too numerous to mention, have long been available in the art. Some of these purses have even been constructed of transparent materials, such as a clear polymer, or which incorporate Plexiglas type of panels, so that the interior contents of the purse can be seen.

It is believed that there is also prior art wherein a light may be embedded within a purse, operated from a battery system, so that when the purse is opened, the interior of the purse is illuminated, to help the woman to see amongst the numerous contents of the employed purse.

These are examples of various styles of purses, that may even be electrified, for lighting purposes, that may be available in the art.

The current invention is designed to provide for a combination of select of these elements, but done so in a unique way that adds to the decorativeness of the purse, so as to enhance its attractiveness, and acceptance by the users, particularly of the younger generation.

SUMMARY OF THE INVENTION

This invention contemplates the formation of a purse, having various of its segments, or the entire purse, fabricated of transparent materials, so that when a unique type of illumination means is added to the purse, it is rather striking of appearance, adding to the fashionability of the purse, and attracts attention to the purse, and its user.

This invention is designed to provide for a structured purse, having a main body portion, with an upper lid that may be hingedly connected thereto, with segments, or the entire structure, of the main body of the purse, and/or its lid portion, being fabricated of transparent material, such as Plexiglas, polyethylene, or any of the other type of more rigid form of polymers that may be fabricated into a clear transparency, or even tinted to select colors, the various segments around the perimeter of the purse, so as to furnish an attractiveness to the light structure that illuminates the interior of the purse, and irradiates externally thereof, to any observer.

The structure of the purse may be fabricated from various wire material, or extruded metal, that forms the structural brace for fabrication of the main body portion of the purse, and the lid structure may be fabricated in a like manner, as devised. The various panels of transparent material may fit within the extrusions forming the structure of the purse, to that they can be slid into place, preferably from the upper edge of the main body portion of the purse, and then a further brace may be supplied thereto, as a structural cap, to hold each of the emplaced panels firmly affixed within their installed framework.

The bottom structure of the purse may simply be fabricated similarly, at the bottom, and onto which a small circuitry, such as a battery in combination with various electronic components, that may generate sufficient energy to illuminate the lighting material that may be plugged into the battery jacks, operatively associated with the circuitry. In addition, the bottom of the purse may be fabricated incorporating a false bottom, so as to provide a lower compartment into which the battery pack and its circuitry may be located, with the lid of the false bottom having the plug-in jacks associated therewith, and into which the jack of the illuminating material may be plugged, for illumination, when the off-on switch is initiated.

In the preferred embodiment, this invention contemplates the usage of a product identified as an electroluminescent wire, which is marketed under the trademark LyTec®, marketed by a company named ELAM USA, Inc., 2 Seaview Blvd., Suite 101, Port Washington, N.Y. 11050. This type of electroluminescent material is in strand form, manufactured as a cable-like light source, which comprises at least two electrodes mutually disposed in such a way as to create between them an electric field such that when a voltage is applied to them, at least one type of pulverulent electroluminophor dispersed in a dielectric binder and disposed in such proximity to the electrodes are effectively excited by the electric fields when created and to admit light of a specific color, the entire cable like means being sheathed within a transparent polymer casing, as constructed.

The object of this invention is to apply such electroluminescent cable like light source, or strands of it, into a transparent purse, plug the same into its battery pack, close the switch, so that light, of a variety of colors, may be emitted therefrom, to add to the novelty and attractiveness of the purse, primarily as an attention gatherer.

Another object of this invention is to provide for a new design in an acrylic or other polymer type of purse which adds its own illuminescent therein, to achieve a radiant lighting display of one or more colorations.

Still another object of this invention is to provide a purse, incorporating a false bottom, and into which a battery pack and circuitry may locate, and into which cable-like electroluminescent light source may be electrically coupled, for radiantly illuminating the purse, with a multi-colored source, while at the same time allowing the interior of the purse to be normally used for containment of a variety of personal items, as normally employed by the female.

These and other objects may become more apparent to those skilled in the art upon reviewing the summary of the invention as provided herein, and upon undertaking a study of the description of its preferred embodiment, in view of the drawings.

DESCRIPTION OF THE PREFERRED EMBODIMENT

Figure 1:
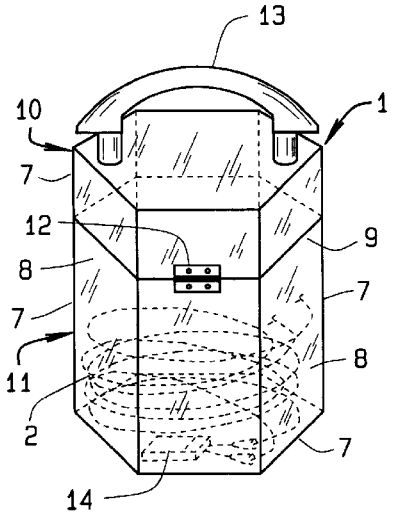
FIG. 1 is a perspective view of the purse of this invention showing incorporating therein the rope-like light source of this invention.

In referring to the drawings of this invention, it generally includes an innovative rope light with endless uses such as the purse 1 of this invention. The cable-like electroluminescent light source, formed of the cables 2, and shown embodied within the purse, may be available in various colors, such as lime green, orange, purple, pin white, marine blue, and yellow, all of which can be illuminated by the circuitry of FIG. 3, showing the battery 3 with on-off switch 4, incorporating jacks 5, and into which the plug 6 of the cable-like illuminescent means 2 may be plugged in, for illumination.

The purse 1 is generally structured of a framework, which may be fabricated of rigid wires 7, or these may comprise extrusions, having side slots, angularly disposed, and which the transparent panels 8 may be slid, during fabrication of the shown purse. Then, cap structures 9 may be applied thereon, in order to embrace and hold the panels 8, within the structure of the purse, as assembled. The lid 10 of the purse may also be fabricated in the same manner as the main body portion 11, and hinged in place by means of the hinge 12. Then, to the lid 10 of the purse may include a handle 13, to facilitate its carriage. Obviously, any type of locking device, such as a clasp (not shown), may interconnect between the lid 10 and the main body portion 11 of the purse, to secure it into closure, as during conveyance.

Figure 3:
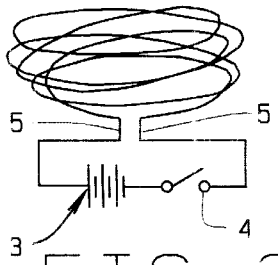
FIG. 3 provides a brief schematic of the circuitry of this invention, which at a minimum, may incorporate a battery, switch, and jacks for plug in of the cable-like electroluminiscent light source.

As can be seen, in the bottom of the purse is incorporated a battery pack 14 and into which the cable-like light source 2 may be plugged, and once the battery pack, or more specifically its circuitry, as explained in FIG. 3, is switched on, the light sources may illuminate, either in white light, or in any combination of the coloration as previously explained, radiantly illuminating from the purse, through its transparent panels.

Figure 2:
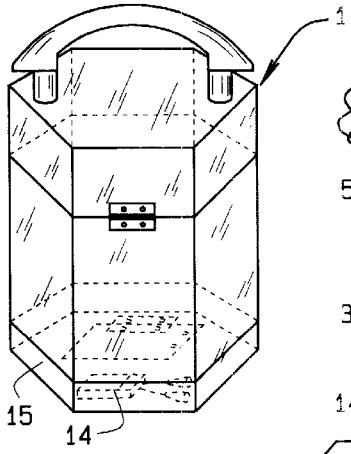
FIG. 2 discloses a related or slightly modified purse of this invention, incorporating-a false bottom, and into which the battery pack and circuitry may locate.
Figure 4:
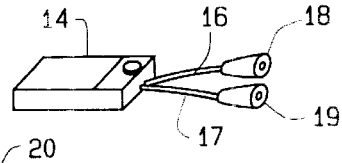
FIG. 4 is a view of a containment structure for the battery pack of this invention, having its plug-in jacks connected by short lengths of electrical cable thereto.

FIG. 2 shows a similar construction for the purse 1, but in this particular instance, the purse may be fabricated having a false bottom, as at 15, and into which the battery pack 14 may locate, for plug in of the cable-like light source, as previously referred to. As can be noted, as in FIG. 4, the battery pack 14 includes a pair of extending electrical cables 16 and 17, having jacks 18 and 19 at their ends. It is into these jacks that the plugs 6 of the light sources may electrically connect, to provide for the light cable illumination.

Figure 7:
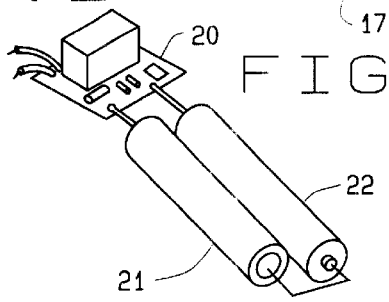
FIG. 7 shows the battery pack and circuit board, incorporating an inverter, for illuminating the light source of this invention.

Furthermore, and while the circuitry as previously explained in FIG. 3 may provide for energization of the cable-like light source, if it is required that the light source must be energized from alternating current, then the circuitry may include any type of an inverter for achieving the conversion of the charge from the battery 3, for energization of the electrical light source, during usage. Such inverter may be included upon the circuit board 20, as shown in FIG. 7, and which interconnects with the pair or more of batteries 21, and 22, as noted. Or, perhaps one battery may suffice.

Figure 8:
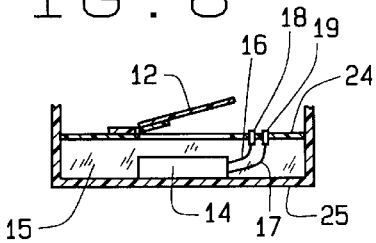
FIG. 8 is a bottom sectional view of the purse disclosing its false bottom forming a compartment for retention of the battery pack and circuitry of this invention.

As can be seen in FIG. 8, the false bottom 15 forming the shown compartment may have access through a door 23, which may locate either upon the false bottom 24, or may attain access through the bottom wall 25, as may be desired for the preferred design. In addition, the battery pack 14 extends its cables 16 and 17 upwardly, to affix their jacks 18 and 19 through the false wall 24, so as to allow the plug 6 of the cable-like light sources to plug readily therein, for illumination. In addition, the switch for the battery pack may also be provided upon the false bottom 24, to allow for its ready access, to be switched on or off, as desired.

Figure 5:
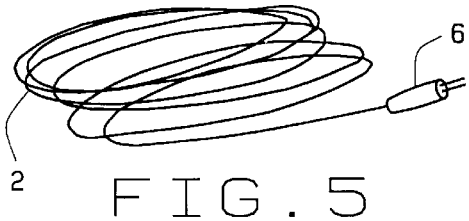
FIG. 5 shows a cable-like electroluminescent light with electrical plug at its end.
Figure 6:
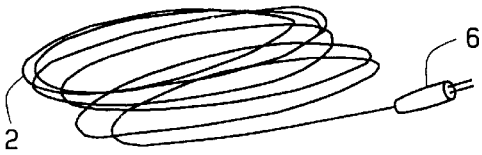
FIG. 6 is a related type of light source, which may be of a different coloration, for use in combination with the light source of FIG. 5.
Figure 9:
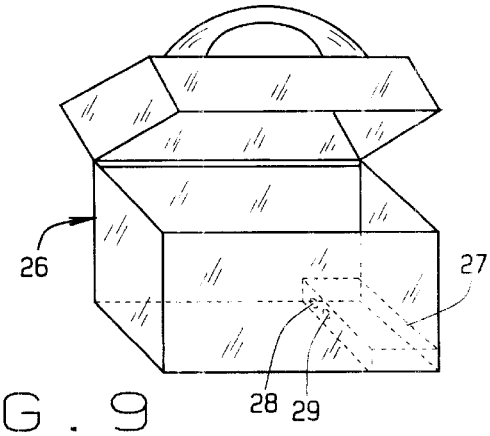
FIG. 9 shows another style of container, which may also be formed of transparent material, held within a structural framework, and having a small compartment in one lower corner for retention of the battery pack and circuitry of this invention.

As can be noted from the structure of the cable-like material 2, as disclosed in FIGS. 5 and 6, this light source may be to almost any length, from one foot to perhaps even dozens of feet, depending upon the amount of light desired, for illumination purposes. In addition, the shape of the shown purse can be to any desired configuration, whether it be the hexagonal as disclosed, or it can even be square, round, or any other acceptable shape, or even rectangular of design, as can be seen at 26 in FIG. 9. Under this circumstance, a small compartment 27 may be provided in the lower corner of the purse, having plug-in jacks 28 and 29 provided therethrough, and into which the cables may be plugged, for usage. Obviously, other methods for capturing the battery pack could be included in the structure of this device, as by clipping it into the purse, or by other methods. Other type purses, of other shapes, and made of other materials, such as polymer or a polyethylene, may be used in this design.

Variations or modifications to the subject matter of this invention may be occur to those skilled in the art upon reviewing the disclosure as provided herein. Such variations of structure, if within the concept of this development, is intended to be encompassed within the scope of the invention as depicted, shown, and described herein. The description of the preferred embodiment as set forth in this disclosure is provided for illustrative purposes only.

What is claimed is:

1. An illuminated decorative purse comprising a structural framework forming a body providing the sides and bottom of a purse, a lid applied onto the body of the purse, said body and lid being formed having various panels, at least one of said panels being formed of transparent material, a battery pack provided at the bottom of the purse, and structurally incorporated therein, a light electrically connected with the battery pack within the purse to provide for its illumination when illuminated, a switch provided between the battery pack and the light to provide for a switching on or off of the light as required, a series of transparent panels provided within both the body and the lid of the purse, to thereby provide for the emission of radiant light from all portions of the purse when the light is illuminated, the light source comprising a cable-like illuminated light source and is a strand form cable-like light source, to thereby provide for an emitting of light from the interior of the purse to the exterior to provide for a radiant lighting display adding to the attractiveness of the purse during usage.

2. The illuminated decorative purse of claim 1 wherein the said panels are clear transparent.

3. The illuminated decorative purse of claim 1 wherein at least one of the panels is tinted to provide for the emission of color light from the purse during illumination of the light source.

4. The illuminated decorative purse of claim 1 wherein the battery pack is originally secured to the bottom of the bottom structure of the purse.

5. The illuminated decorative purse of claim 1 wherein the purse body is formed with a false bottom, and the battery pack and its circuitry being contained within the false bottom of said purse.

6. The illuminated decorative purse of claim 5 wherein the false bottom includes a door to attain access therein for replacement of a battery pack as required.

7. The illuminated decorative purse of claim 1 wherein a door is provided upon the battery pack to obtain access into the battery pack for replacement of any battery contained therein.

8. The illuminated decorative purse of claim 1 wherein the purse lid structure is hingedly secured to the purse body.

9. The illuminated decorative purse of claim 1 and including a handle applied to the top of the lid structure to facilitate carriage of the said purse during usage.

10. The illuminated decorative purse of claim 1 and including a circuit board, the circuit board is electrically connected to the battery pack, said circuit board including an electronic inverter for converting the energy to alternating current for operations of the light source.

11. The illuminated decorative purse of claim 10 wherein said circuit board includes plug-in jacks, said jacks being provided for plug-in of circuitry to provide for access of the light to energy from the battery pack during operations of the illuminated decorative purse.

12. The illuminated decorative purse of claim 1 wherein the cable-like light source emits a colored light.

13. An illuminated decorative purse comprising a structural framework forming a body providing the sides and the bottom of the purse, a lid applied onto the body of the purse, said body and lid being formed having various panels, at least one of said panels incorporated in the body being formed of transparent material, a battery pack provided at the bottom of the purse, and structurally incorporated therein, a light electrically connected with the battery pack within the purse to provide for its illumination when illuminated, a switch provided between the battery pack and a light to provide for a switching on or off of the light as required, there being a series of transparent panels provided within the body of the purse, to thereby to provide for the emission of radiant light from all portions of the purse when the light is illuminated, said light source comprising a cable-like illuminated light source and is a strand form cable-like light source, to thereby provide for an emitting of light from the interior of the purse to the exterior to provide for a radiant lighting display adding to the attractiveness of the purse during usage.

14. An illuminated decorative purse comprising a structural framework forming a body providing the sides and bottom of the purse, a lid applied onto the body of the purse, said body and lid being formed of various panels, at least one of said panels in the lid being formed of transparent material, a battery pack provided at the bottom of the purse, and structurally and incorporated therein, a light electrically connected with the battery pack within the purse to provide for its illumination when illuminated, a switch provided between the battery pack and the light to provide for a switching on or off of the light as required, there being a series of said transparent panels provided within the lid of the purse, to thereby provide for the emission of radiant light from all portions of the lid when the light is illuminated, said light source comprising a cable-like illuminated light source and is a strand form cable-like light source, to thereby provide for any emitting of light from the interior of the purse to the exterior through its lid to provide for a radiant lighting display adding to the attractiveness of the purse during usage.

15. An illuminated decorative purse comprising a structural framework forming a body providing the sides and bottom of a purse, a lid applied onto the body of the purse, said body and lid being formed having various panels, at least one of said panels being formed of transparent material, a battery pack provided within the purse, and structurally incorporated therein, a light electrically connected with the battery pack within the purse to provide for its illumination when illuminated, a switch provide between the battery pack and the light to provide for a switching on or off of the light as required, a series of transparent panels provided within both the body and the lid of the purse, to thereby provide for the emission of radiant light from all portions of the purse when the light is illuminated, the light source comprising a cable-like illuminated light source and is a strand form cable-like light source, to thereby provide for an emitting of light from the interior of the purse to the exterior to provide for a radiant lighting display adding to the attractiveness of the purse during usage.

* * * * *